US005123539A

United States Patent [19]

de Vries et al.

[11] Patent Number: 5,123,539

[45] Date of Patent: Jun. 23, 1992

[54] TABLET DISPENSING CONTAINER

[75] Inventors: Alphons B. de Vries; Gerrit Van Binsbergen, both of Sneek, Netherlands

[73] Assignee: Sara Lee/DE N.V., Utrecht, Netherlands

[21] Appl. No.: 672,534

[22] Filed: Mar. 20, 1991

[30] Foreign Application Priority Data

Mar. 20, 1990 [NL] Netherlands ..... 9000640

[51] Int. Cl.[5] ..... B65D 83/04

[52] U.S. Cl. ..... 206/532; 206/534.2; 206/538; 221/309; 221/312 C

[58] Field of Search ..... 206/528-540, 206/534.1, 534.2; 221/302, 305, 307, 309, 312 C

[56] References Cited

U.S. PATENT DOCUMENTS

| | | | |
|---|---|---|---|
| 1,156,598 | 10/1915 | Hathaway | 221/309 |
| 1,157,951 | 10/1915 | Monroe | 221/309 |
| 1,215,123 | 2/1917 | Dalton et al. | 221/309 |
| 2,422,605 | 6/1947 | Wells | 206/540 |
| 2,878,928 | 3/1959 | Ivy | 206/528 |
| 2,917,162 | 12/1959 | Horland | 206/538 |
| 3,018,921 | 1/1962 | Hermanson | 206/534.2 |
| 3,807,601 | 4/1974 | Frankenberg | 221/307 |
| 4,172,523 | 10/1979 | Weglage | 221/307 |
| 4,502,612 | 3/1985 | Morrison | 221/307 |

FOREIGN PATENT DOCUMENTS

| | | | |
|---|---|---|---|
| 0460460 | 1/1937 | United Kingdom | 221/307 |
| 2071618 | 9/1981 | United Kingdom . | |

*Primary Examiner*—Jimmy G. Foster

*Attorney, Agent, or Firm*—Cushman, Darby & Cushman

[57] ABSTRACT

A dispenser for containing and dispensing products such as tablets, sweets and the like, including a generally thin, flat, box-like container having a lip-shaped exit portion at a circumferential edge. The dispenser may include a weakened portion at the lip; shaped exit portion and an ascending edge portion at the lip shaped portion.

3 Claims, 1 Drawing Sheet

TABLET DISPENSING CONTAINER

BACKGROUND OF THE INVENTION

This invention relates to a disperser designed for containing and dispensing products such as tablets, sweets, and the like, comprising a generally flat container. It is well known to package medicinal tablets in so-called blister packs. The same types of packages sometimes are used for containing and dispensing for pieces of chewing gum and the like.

Sweets are usually packaged in rolls, or alternatively, in flat boxes with a sliding lid or a tab opening, as in the case of dispensers for lozenges, troches and the like or for peppermint pastilles, such as Tic-Tac® pastilles.

All of these known dispensers, however, have the drawback that opening them and extracting one or more items of the product requires the use of a user's two hands.

SUMMARY OF THE INVENTION

It is an object of the invention to overcome the aforementioned drawback and to provide a dispenser that permits opening and extracting a product using one hand. It goes without saying that items of the product must be well protected in the dispenser and, further, the dispenser must permit easy arrangement in a display. A further requirement, accordingly, is that the dispenser must be flat and smooth, so that it can also be readily accommodated in a pocket of a jacket, a breast for instance.

To that end, the dispenser according to the invention is a planar, box-like member having a lip-shaped exit portion at a circumferential edge.

To ensure easy extraction, at the lip-shaped exit portion the dispenser may be provided with a weakened portion which can be opened readily, for instance by pushing a tablet against it.

To facilitate extraction, at the lip-shaped portion the dispenser may be provided with an ascending edge portion. Extraction is further facilitated when, at the ascending edge, the container wall is provided with a grip opening bounded by a tear joint. This grip opening may for instance be elongated.

To ensure proper one-by-one extraction of the tablets, the container may be provided with one or more guiding or dividing ridges extending into the receiving space for the product.

BRIEF DESCRIPTION OF THE DRAWINGS

To elucidate the invention, one embodiment of the dispenser will now be described, with reference to the accompanying drawings, in which.

DETAILED DESCRIPTION

Figure 1:
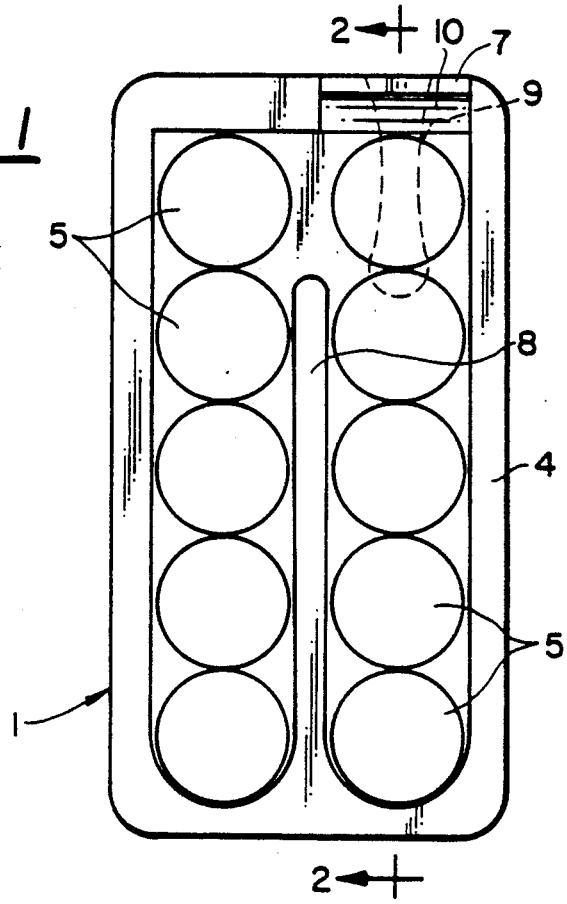
FIG. 1 is a diagrammatic plan view of a dispenser.
Figure 2:
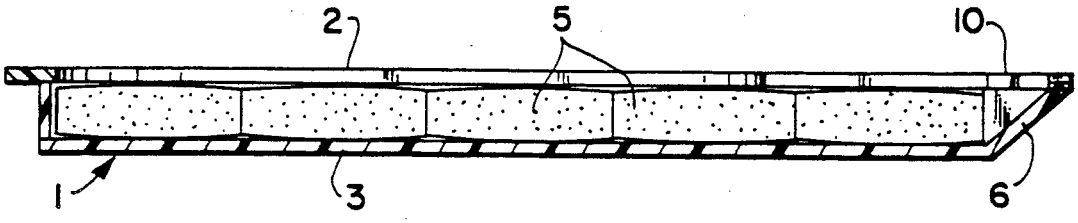
FIG. 2 is a sectional view taken on the line II—II of FIG. 1.

As shown in FIGS. 1 and 2 of the drawing, the dispenser 1 is a planar cover member 2 and a box-body member 3.

The members 2 and 3 can both be formed of plastic material and bonded to each other at an outer perimetrical joint 4 formed between an inner face of the cover member 2 and an upper edge of the outer perimetrical sidewall of the box body member 3. As will further appear from the drawings, for an individual tablet such as a peppermint or a sweet 5 to be extracted from the dispenser, the outer perimetrical sealing joint must be interrupted at a particular location, throughout a segment of the joint which is sufficiently broad as to permit a table to thereafter pass out of the container through the joint-disruption or opening thereby formed. At this location the cover member 2 and/or the box body member 3 adjacent and leading to the respective circumferential edges which were pulled apart as the joint is locally disrupted to provide the dispensing opening are provided with an ascending portion 6 (see FIG. 2). In the preferred embodiment, the ascending portion is shown as having been provided entirely in the bottom and outer peripheral edge walls of the box body 3. It will be clear, however, that such an ascending portion could, instead, be formed as part of the flat cover member. Of course, it is also possible to form the ascending portion partly in the cover member and partly in the box body member.

To enable easy outward shifting of the tablets 5, one-by-one towards the opening formed between respective edge portions of the cover and box body portions, the cover member, adjacent and leading to the outer peripheral edge thereof at the location of the intended joint-disruption or opening is preferably provided with a means for providing a grip opening 10. The grip opening is shown in FIG. 1 in dash lines since at the time that a dispenser is offered for sale the grip opening will not yet be open, but will exist as a region of the cover member, bounded by the outer peripheral edge of the cover member and a line of weakness, along which the respective region may be torn or broken away from the remainder of the cover member, so as to provide the grip opening 10. By providing a lip-shaped portion 9 with a perforation or a different kind of weakened portion at the grip or dispensing opening 10, this lip-shaped portion can readily be removed, whereafter extraction of the tablets can take place without difficulty. In contrast with what has been stated hereinabove, in practice the dispenser will be closed at the dispensing opening, i.e. the planar and box-like members of the container will be bounded to each other by sealing along a very narrow edge portion, designated here by 7. After removal of the lip-shaped portion 9, the remainder of the edge portion can readily be opened by pushing a tablet 5 against it.

Another particularity of the dispenser according to the invention is that at the central portion, in longitudinal direction, a raised portion is provided, which forms a guiding or dividing ridge 8 which extends within the product-receiving space for guiding the tablets one-by-one towards the location from which they can be gripped through the opening 10 (from which the lip-shaped portion 9 has been removed), and slid out of the container between the separated edge portions at 7.

What we claim is:

1. A dispenser for tablets having a given thickness, comprising:

a box body having a generally planar bottom wall having an outer periphery, and a sidewall extending about the outer periphery of said bottom wall; and a generally planar cover plate having an outer periphery;

edge means perimetrically joining said cover plate about the outer periphery thereof to said sidewall, distally of said bottom wall, so as to define between said cover plate and said bottom wall, bounded by said sidewall, a tablet-receiving space which is at least as thick as said given thickness, but less than twice as thick as said given thickness, so only one layer of tablets may occupy said space; said edge means throughout a portion of said sidewall and throughout a corresponding portion of said cover plate being separable, so as to provide an outlet for serially dispensing individual tablets from said dispenser; and means defining a generally U-shaped line of weakness on said cover plate, contiguous, at two opposite ends of said line of weakness, with said outer periphery of said cover plate at the respective said edge portion, whereby upon removal of a portion of said cover plate along said line of weakness, a grip opening, narrower than a tablet, is formed, through which successive tablets may be manually urged out of said dispenser between said edge portions.

2. The dispenser of claim 1, further including:

a ramp formed in said box body leading towards said edge portion of said sidewall, for elevating each tablet, urged through said grip opening, in such a sense as to temporarily spread apart said edge portions for dispensing such tablet therebetween.

3. The dispenser of claim 1, further including:

means providing a set of dividing ridges within said space, for organizing tablets into a pattern for successively feeding individual tablets towards said edge portions.

* * * * *